United States Patent [19]

Kobayashi et al.

[11] Patent Number: 4,773,369

[45] Date of Patent: Sep. 27, 1988

[54] METHOD OF CONTROLLING AN OUTPUT OF AN INTERNAL COMBUSTION ENGINE AND/OR A VARIABLE DISPLACEMENT HYDRAULIC PUMP DRIVEN BY THE ENGINE

[75] Inventors: Takeshi Kobayashi, Hirakata; Hideyuki Takehara, Yawata; Akihisa Takahashi; Yukio Moriya, both of Hirakata; Hideo Kawai, Yawata, all of Japan

[73] Assignee: Kabushiki Kaisha Komatsu Seisakusho, Tokyo, Japan

[21] Appl. No.: 832,806

[22] Filed: Feb. 25, 1986

[30] Foreign Application Priority Data

Feb. 28, 1985 [JP] Japan ..... 60-37641
Feb. 28, 1985 [JP] Japan ..... 60-37642
Feb. 28, 1985 [JP] Japan ..... 60-37643

[51] Int. Cl.[4] ..... F02M 39/00

[52] U.S. Cl. ..... 123/357; 123/385; 123/339; 417/216

[58] Field of Search ..... 123/357, 358, 359, 385, 123/386, 387, 339; 417/216, 218, 222, 53

[56] References Cited

U.S. PATENT DOCUMENTS 4,359,130 11/1982 Kirkham ..... 417/216
4,382,485 5/1983 Kirkham ..... 417/216
4,498,847 2/1985 Akiyama ..... 417/216
4,600,364 7/1986 Nakatani et al. .
4,606,313 8/1986 Izumi ..... 123/357
4,637,781 1/1987 Akiyama ..... 417/216
4,638,779 1/1987 Kitada ..... 123/385
4,640,245 2/1987 Matsuda ..... 123/339
4,643,146 2/1987 Spriessler ..... 123/339

FOREIGN PATENT DOCUMENTS 0073288 3/1983 European Pat. Off. ..... 123/385

*Primary Examiner*—Carl Stuart Miller
*Attorney, Agent, or Firm*—Armstrong, Nikaido, Marmelstein & Kubovcik

[57] ABSTRACT

A method of controlling an output of an internal combustion engine having an electronic governor device and/or that of at least one variable displacement hydraulic pump driven by the engine in which, when the engine is operated in a range of high speed revolutions approximately equal to or exceeding the number of revolutions of the engine at a rated point on a governor control curve specific to the engine, the engine is operated by the action of the electonic governor device at a given point of a curve of equal horsepower of the engine where an engine output torque is higher than that in the high speed revolution range and where fuel consumption is lower than that in the range.

4 Claims, 11 Drawing Sheets

METHOD OF CONTROLLING AN OUTPUT OF AN INTERNAL COMBUSTION ENGINE AND/OR A VARIABLE DISPLACEMENT HYDRAULIC PUMP DRIVEN BY THE ENGINE

BACKGROUND OF THE INVENTION

1. Field of the Invention

This invention relates to a method of controlling an output of an internal combustion engine and/or a variable displacement hydraulic pump driven by the engine. More particularly, it relates to a control method which enables the efficient operation of an internal combustion engine or a pump driven by the engine, or both, while maintaining the fuel consumption of the engine at a low level.

2. Description of the Prior Art

There is known an internal combustion engine of the type which is controlled in accordance with a specific pattern irrespective of any change in the torque requirement of a variable displacement hydraulic pump (hereinafter referred to simply as the variable pump) which is driven by the engine, i.e., its built-in displacement multiplied by its output pressure. The torque requirement of the variable pump is altered by a mode selector control device to maintain the fuel consumption of the engine at a low level. See copending U.S. patent application Ser. No. 717,197 filed by T. Akiyama et al., now U.S. Pat. No. 4,637,781, dated Jan. 20, 1987.

The engine has a fuel injection device including a mechanical all-speed type governor. The curve b in FIG. 1 is a governor control curve and each of curves $a_1$ to $a_5$ shows a specific amount of fuel consumed by the engine in such a way that its fuel consumption decreases in the order of curves $a_5$ to $a_1$. The fuel consumption of the engine is always fixed at a specific point on the governor control curve b. For example, it is shown by the curve $a_3$ at a rated point C on the curve b.

The work (mode) of the variable pump which is driven by the engine having such governor control characteristics may, for example, be variable in three stages, i.e., a high-load mode $M_1$, a medium-load mode $M_2$ and a low-load mode $M_3$, as shown in FIG. 2. Then, the engine is controlled by the mechanical governor for operation at points C (rated point), S and L on the governor control curve b, respectively. When the mode of the variable pump is altered, the engine has an output torque which greatly differs from one mode to another, though the number of revolutions of the engine is maintained substantially at a constant level.

As a result, the torque requirement of the variable pump also differs greatly from one mode to another, as shown in FIG. 2. As the variable pump is so designed as to show the best efficiency in one of its modes, for example, $M_1$, its efficiency greatly differs from one mode to another. Therefore, it has the disadvantage of failing to utilize the output of the engine effectively in either of the modes other than $M_1$.

Each of curves in FIG. 2 is a curve of equal variable pump efficiency. The efficiency of the pump is shown as increasing with a decrease in the radius of curvature of the curves.

Moreover, the control of the engine by the conventional mechanical governor has the disadvantage that the engine consumes a large amount of fuel at a low load, as shown at point L in FIG. 1.

SUMMARY OF THE INVENTION

Under these circumstances, it is a first object of the present invention to provide a method of controlling an output of an internal combustion engine provided with an electronic governor in which, in order to reduce a difference between curves of equal pump output (along each of which the output pressure of a variable pump multiplied by its built-in displacement expressed as cc/rev. is constant) from one mode of the pump to another, i.e., a difference between torque requirements of the pump from one mode to another, the engine is operated in such a manner that an output torque of the engine in a range of high speed revolutions at a rated point of each of the modes is altered to that at a given point on a curve of equal horsepower (along which the output torque of the engine multiplied by the number of revolutions of the engine is constant) in each mode where is near the maximum output torque point of the engine on the equal horsepower curve in each mode and has fuel consumption lower than that in the range of the high speed revolutions.

It is a second object of the present invention to provide a method of controlling an output of an internal combustion engine provided with an electronic governor for lowering the number of revolutions of the engine in accordance with a drop of its output torque below a predetermined level in order to reduce its fuel consumption and the noise which its produces, when it is operating at a low load.

It is a third object of the present invention to provide a method of controlling an output of an internal combustion engine provided with an electronic governor and an output of a variable pump driven by the engine, which is characterized by maintaining a swash plate for the variable pump at a maximum angle to minimize its built-in displacement at a low load, increasing the output torque of the engine along a curve of equal horsepower within a predetermined range of equal fuel consumption to increase an output pressure of the pump, and decreasing the angle of the swash plate, while maintaining the output torque of the engine at its increased level, to decrease the built-in displacement of the pump along a curve of equal pump output and increase its output pressure with an increase in load, whereby the pressure loss of the variable pump is reduced and the output torque of the engine by which the pump is driven is effectively utilized.

These objects are attained by a method of controlling an output of an engine provided with an electronic governor device and/or at least one variable displacement hydraulic pump driven by the engine, characterized in that, when the engine is operated in a range of high speed revolutions approximately equal to or exceeding the number of revolutions at a rated point on a governor control curve specific to the engine, the engine is operated by the action of the electronic governor device at a given point on a curve of equal horsepower where an engine output torque is higher than that in the range of the high speed revolutions and where fuel consumption is lower than that in the range of the high speed revolutions, so that the engine and/or the pump may be operated with a high efficiency.

According to another aspect of the present invention, there is provided a method of controlling an output of an internal combustion engine provided with an electronic governor in which the output setting for the engine is variable in a plurality of modes to alter a torque requirement of a variable displacement hydraulic pump driven by the engine, which comprises operating the engine in such a manner that the output torque of the engine in a range of high speed revolutions at a rated point of each of the modes is altered to that at a given point on a curve of equal horsepower of the engine in each mode where a maximum output torque point of the engine on the equal horsepower curve is adjacent thereto and where fuel consumption is lower than that in the range of the high speed revolutions.

According to still another aspect of this invention, there is provided a method of controlling an output of an internal combustion engine provided with an electronic governor and adapted for driving at least a variable displacement hydraulic pump, which comprises reducing the number of revolutions of the engine in accordance with a ratio of reduction in the output torque of the engine to a level below a preset value.

According to a further aspect of the present invention, there is provided a method of controlling an output of an internal combustion engine provided with an electronic governor and a variable displacement hydraulic pump driven by the engine, which comprises maintaining a swash plate for the pump at a maximum angle to maximize its built-in displacement at a low load, increasing the output torque of the engine along a curve of equal engine horsepower within a predetermined range of equal fuel consumption to increase the output pressure of the pump, and decreasing the angle of the swash plate, while maintaining the output torque of the engine at its increased level, to decrease the built-in displacement of the pump along a curve of equal pump output and increase its output pressure with an increase in load.

These and other objects, features and advantages of this invention will become apparent to anybody of ordinary skill in the art from the following detailed description and the accompanying drawings.

DETAILED DESCRIPTION OF THE PREFERRED EMBODIMENTS

The control method of this invention will now be described in further detail with reference to FIGS. 3 to 15.

Figure 1:
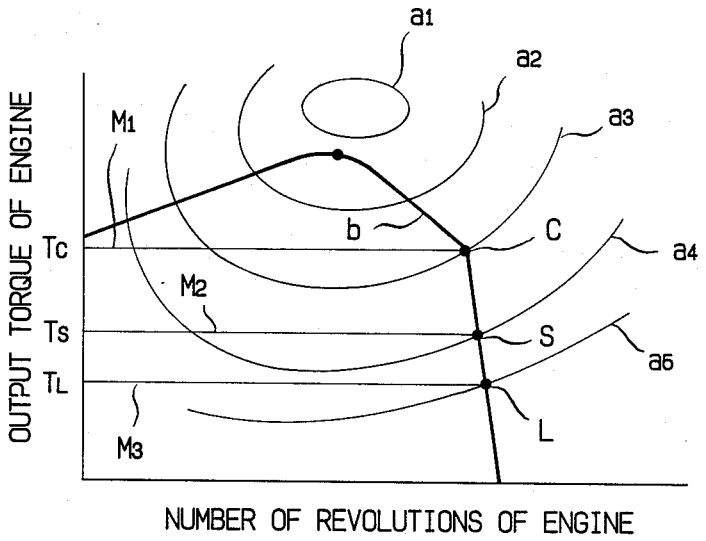
FIG. 1 PRIOR ART
FIG. 1 is a graph showing the conventional control of an engine by a mechanical all-speed type governor.
Figure 2:
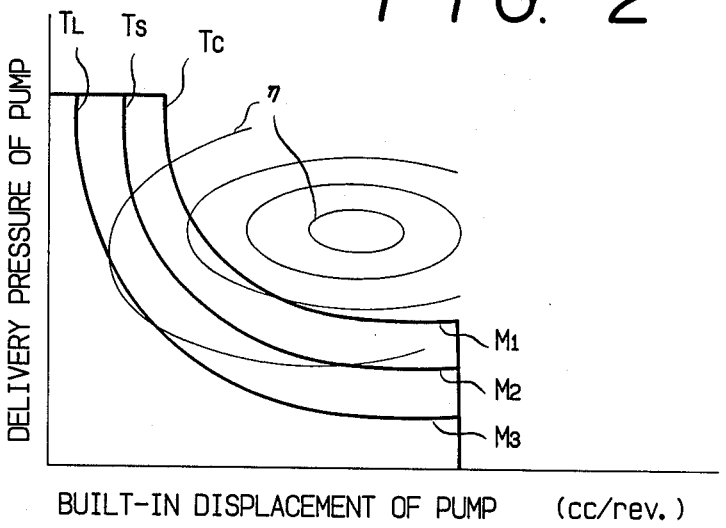
PRIOR ART FIG. 2
FIG. 2 is a graph showing the conventional output control for a variable displacement hydraulic pump.
Figure 3:
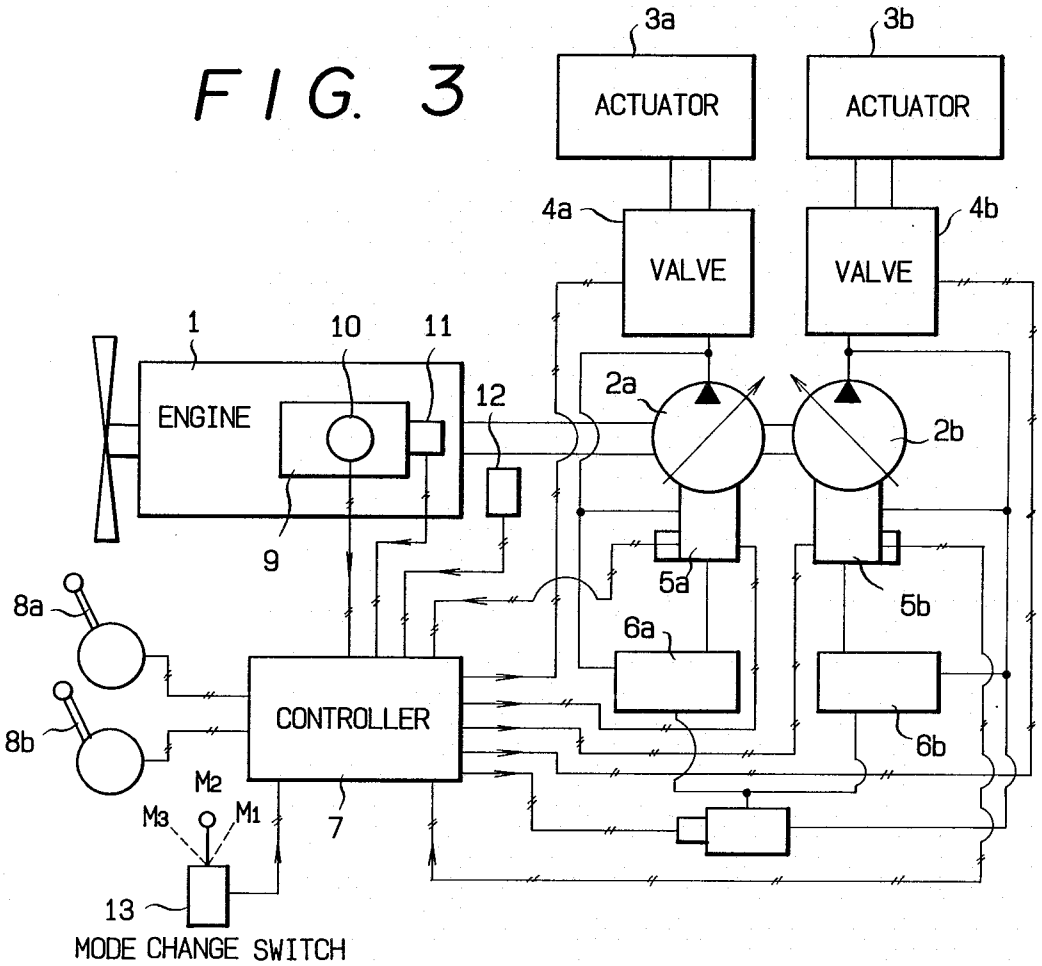
FIG. 3 is a general circuit diagram of a control system embodying the method of this invention for controlling the outputs of an engine and a plurality of variable displacement hydraulic pumps which are driven by the engine.

Referring first to FIG. 3, there is diagrammatically shown a system for controlling the outputs of an engine 1 and two variable displacement hydraulic pumps 2*a* and 2*b*. An actuator 3*a* is connected to the pump 2*a* through a valve 4*a*, and another actuator 3*b* to the pump 2*b* through a valve 4*b*. A servo motor 5*a* for controlling the pump 2*a* is connected to its output side through a control valve 6*a* and a servo motor 5*b* for controlling the pump 2*b* is connected to its output side through a control valve 6*b*.

A controller 7 contains a microcomputer and a pair of electric control levers 8*a* and 8*b* are provided for controlling it. A fuel injector 9 is provided with an electronic governor. A governor potentiometer 10 is provided for detecting its throttle lever position. The fuel injector 9 is also provided with a rack position detector 11. A rotation sensor 12 is provided for detecting the number of revolutions of the engine 1. The outputs of these sensors, as well as those of the servo motors 5*a* and 5*b*, are transmitted to the controller 7. A mode change switch is shown at 13. The output signals of the governor potentiometer 10 and the rotation sensor 12 are processed by the microcomputer in the controller 7 so that it may output an appropriate rack position signal to control the injection of fuel.

Figure 4:
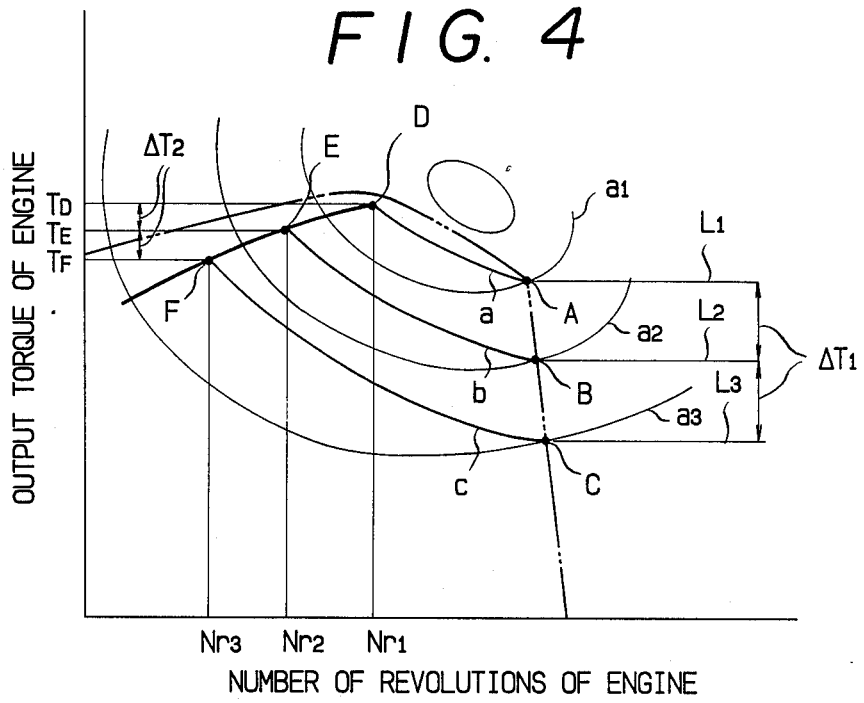
FIG. 4 is a diagram showing a first embodiment of the method of this invention for controlling the output of an engine.

FIG. 4 is a diagram showing a first embodiment of the method of this invention for controlling the output of the engine. A, B and C are the given points indicating the number of revolutions of the engine and its output torque which are required for enabling the hydraulic pump driven by the engine and set for producing a maximum output to produce the maximum output in three different modes $L_1$, $L_2$ and $L_3$, respectively. In other words, A, B and C are the rated load points for the first to third modes, respectively.

Curves a, b and c of equal engine horsepower pass through the rated load points A, B and C, respectively. Curves $a_1$, $a_2$ and $a_3$ of equal fuel consumption also pass through the points A, B and C, respectively, and points D, E and F are given on the curves a, b and c, respectively.

The electronic governor in the fuel injector 7 is so set that the number of revolutions of the engine may be altered along a curve AD in the first mode $L_1$, a curve BE in the second mode $L_2$, or a curve CF in the third mode $L_3$, depending on a change in load. One of the modes is selected in response to a corresponding mode change signal from the mode change switch 13.

Figure 5:
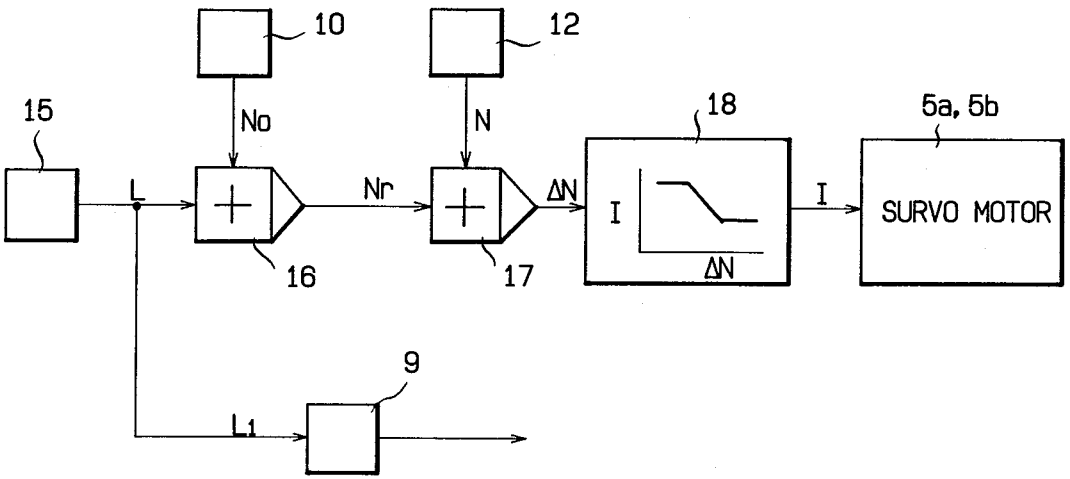
FIG. 5 is a block diagram of a control system which is employed for carrying out the method shown in FIG. 4.

A control system which may be used for carrying out the first embodiment of the method of this invention is shown in the block diagram of FIG. 5. A signal corresponding to one of the modes, for example, the first mode $L_1$, is inputted from the mode change switch 13 (FIG. 3) to the controller 7. The inputted mode $L_1$ signal is detected by a mode detector 15 in the controller 7. The detected mode $L_1$ signal and a signal $N_0$ from the potentiometer 10 are inputted to an operator 16 and the operator 16 outputs a signal representing the target rotating speed $Nr_1$ of the engine in the mode $L_1$. The target number of revolutions $Nr_1$ is the number of revolutions at the point D in FIG. 4. The signal representing the target number of revolutions $Nr_1$ and a signal representing the actual number of revolution N of the engine which has been detected by the rotation sensor 12 are inputted to an operator 17. The operator 17 outputs a signal representing their difference $\Delta N$ ($=Nr_1-N$). The output $\Delta N$ is inputted to a function generator 18 and converted to a signal I which is inputted to the servo system for the pumps. The signal I is a preset signal varying with $\Delta N$ and controls the delivery rate and pressure of each hydraulic pump.

The mode signal $L_1$ is also inputted to the fuel injector 9 to control it in accordance with a pattern stored in the electronic governor, i.e., along the curve AD in FIG. 4, so that the number of revolutions of the engine may be lowered along the corresponding curve of equal horsepower. At a maximum load, the engine is driven at the target number of revolutions $Nr_1$ shown at D to match with the hydraulic pumps.

In the second and third modes, the output of the engine is likewise controlled along the curves BE and CF of equal horsepower, respectively, as shown in FIG. 4.

Figure 6:
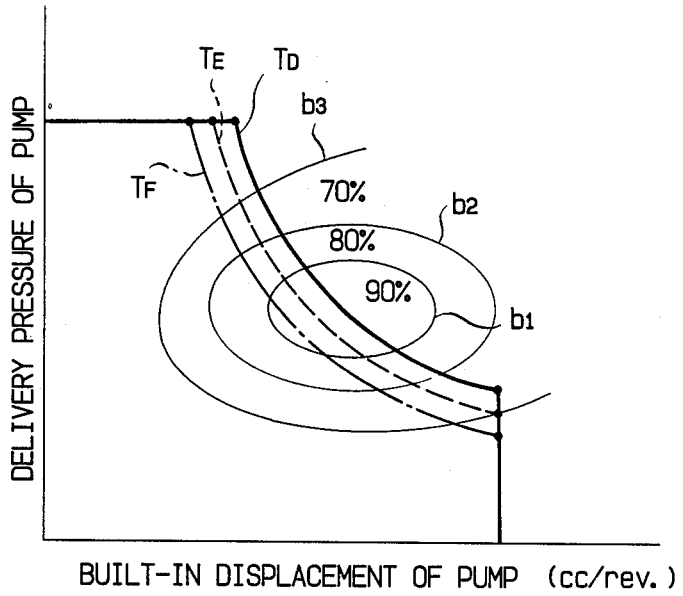
FIG. 6 is a diagram showing a method embodying this invention for controlling the output of a variable displacement hydraulic pump.
Figure 7:
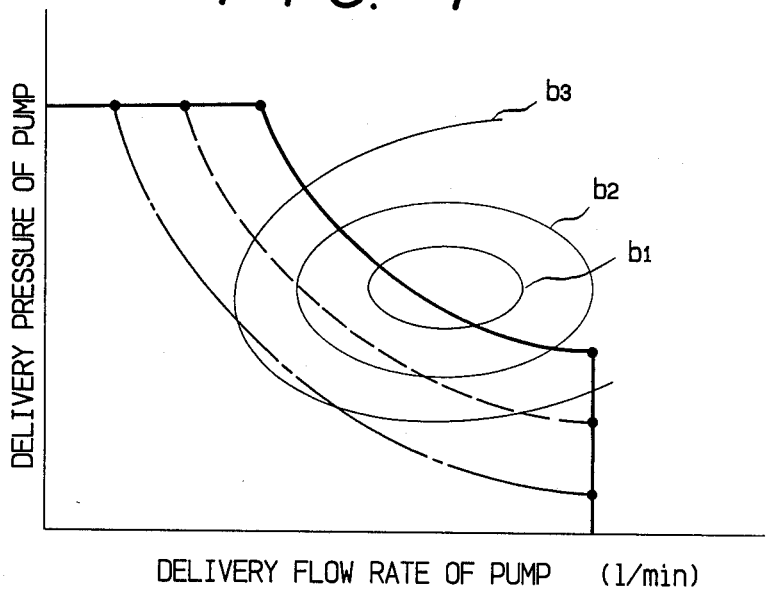
FIG. 7 is a graph showing the output of the pump controlled by the method shown in FIG. 6.

The output torques of the engine at the maximum load points D, E and F define a difference $T_2$ therebetween which is smaller than the difference $T_1$ defined at the points A, B and C. This means a reduction in the difference of the output performances $T_D$, $T_E$ and $T_F$ of the pump defined by its output per revolution and its output pressure when it is driven by the engine rotating at the maximum load points D, E and F, respectively, as shown in FIG. 6. It, therefore, follows that the pump which is designed for working with a maximum efficiency in the first mode $L_1$ works efficiently in the other modes, too. Each of the curves $b_1$, $b_2$ and $b_3$ in FIG. 6 is a curve of equal pump efficiency. FIG. 7 is a graph showing the amount of work done by the pump in each of the modes $L_1$ to $L_3$.

Figure 8:
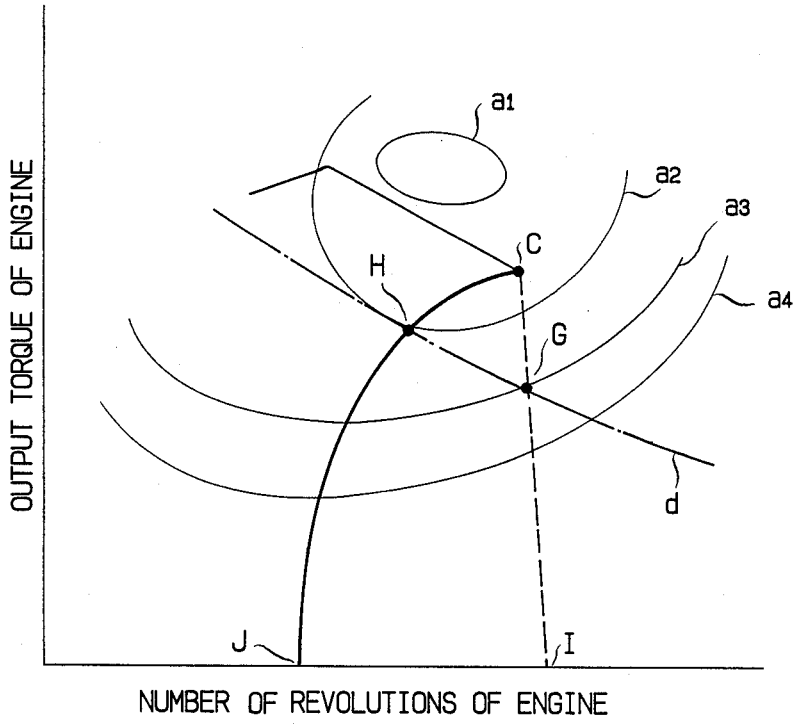
FIG. 8 is a diagram showing a second embodiment of the method of this invention for controlling the output of an engine.

Reference is now made to FIG. 8 showing a second embodiment of the method of this invention for controlling the output of the engine. This method is characterized by controlling the number of revolutions of the engine along a curve CJ passing through the point of minimum fuel consumption on the curve of equal horsepower with a reduction in the output torque of the engine as a result of a decrease in load, as opposed to the conventional method which controls the output of the engine along a curve CI extending from the rated point C of the engine output along the curve showing the control by a mechanical all-speed governor without taking the fuel consumption into account.

The conventional control curve CI crosses the curve d of equal horsepower at a point G on the curve $a_3$ of equal fuel consumption. Therefore, the fuel consumption of the engine at the point G is $a_3$ (g/ps.h). The curve d, however, crosses also the curve $a_2$ of equal fuel consumption. As the amount $a_2$ is smaller than $a_3$, the engine consumes a smaller amount of fuel when operated at the point H, than at the point G. If the points of minimum fuel consumption are likewise obtained for all the other points of horsepower, they define the curve CJ which enables the control of the engine output with a reduction in fuel consumption.

Figure 9:
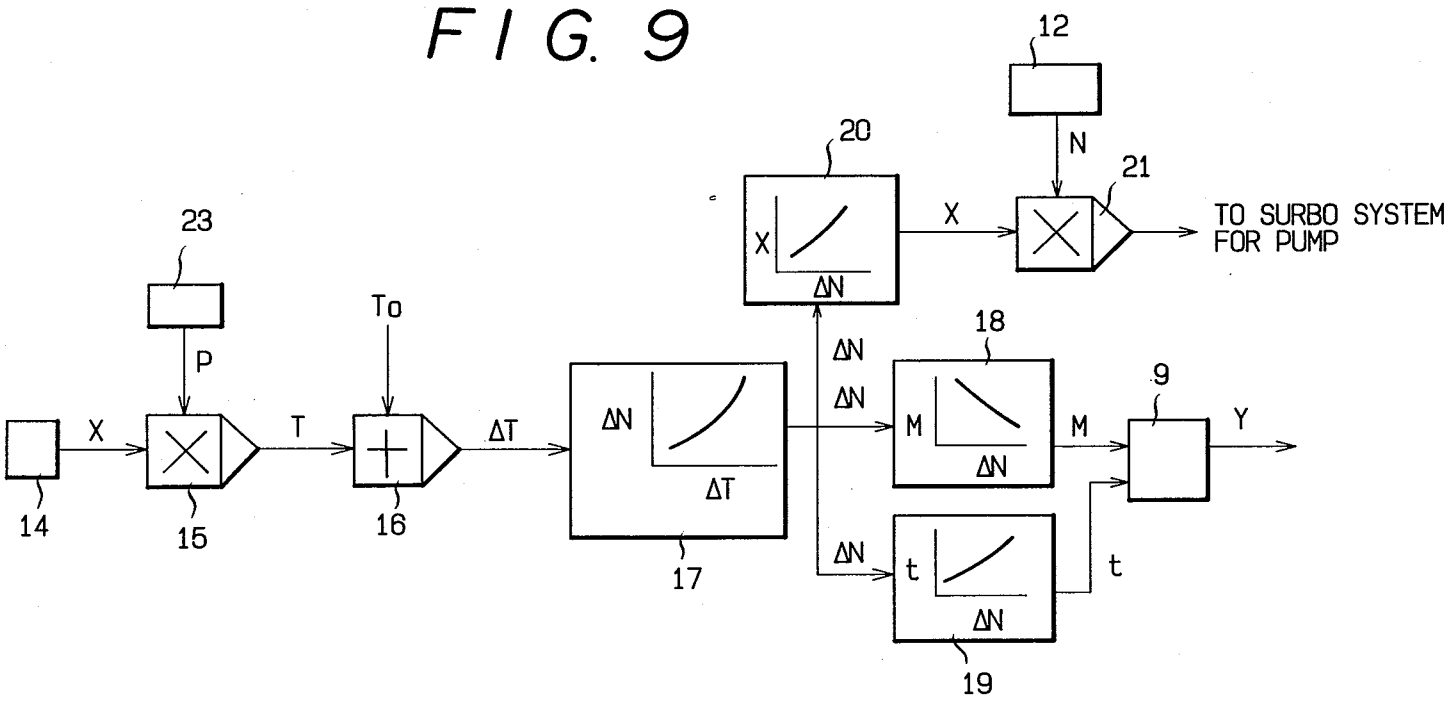
FIG. 9 is a block diagram of a control system which is employed for carrying out the method shown in FIG. 8.

If the method of this invention is applied to a system including a hydraulic pump as shown in FIG. 9, a change in the number of revolutions of the engine at a low load is likely to bring about a change in the operating speed of an actuator. Therefore, the angle of a swash plate for the pump is so controlled as to ensure that the delivery flow rate Q (liters/min.) of the pump, which is equal to its built-in displacement q (cc/rev.) multiplied by the number of revolutions N (rpm) of the engine, be constant.

Referring further to the control system of FIG. 9, a signal P representing the actual output pressure of the pump is inputted from a pump output pressure detector 23 to an operator 15, and a signal X representing the actual output of the pump from a pump tilting detector 14 to the operator 15. The load torque of the pump is thereby calculated and a torque signal T is inputted from the operator 15 to an operator 16. The operator 16 compares the torque T with the target torque $T_0$ set by a throttle lever, and only when T is smaller than $T_0$, it outputs a signal representing their difference $\Delta T$ ($=T_0-T$).

The appearance of the difference $\Delta T$ means that the engine 1 has begun to operate at a lower load, and defines a basis for the curve CJ shown in FIG. 8. The signal $\Delta T$ is inputted to a first function generator 17 and converted to a signal $\Delta N$ representing the difference in the number of revolutions of the engine. The first function generator 17 is designed for storing $\Delta T$ and $\Delta N$ in a relationship defining the curve CJ. The signal $\Delta N$ is inputted to a second, a third and a fourth function generator 18, 19 and 20. It is converted by the second function generator 18 to a rack position change signal M to set the amount Y of fuel injection, and by the third function generator 19 to set fuel injection timing t. If the difference $\Delta N$ between the target number of revolutions of the engine and its actual number of revolutions is large, the rack displacement M is accordingly decreased and the fuel injection timing t slowed down to reduce the amount Y of fuel injection by the fuel injector 9 and thereby lower the number of revolutions of the engine. This lowering in the number of revolution of the engine is likely to cause a sudden change in the output of the pump and therefore a sudden change in the operating speed of the actuator. Therefore, the fourth function generator 20 converts the signal $\Delta N$ to a pump tilting signal X and inputs it to an operator 21 to which a signal representing the number of revolution N of the engine is also inputted. The operator 21 sets a tilting angle for the pump enabling a constant product of X and N to maintain a constant pump output. The greater the lowering in the number of revolution of the engine (i.e., the larger $\Delta N$), the greater the pump tilting signal X is, so that the output of the pump may always be maintained at a constant level.

Figure 10:
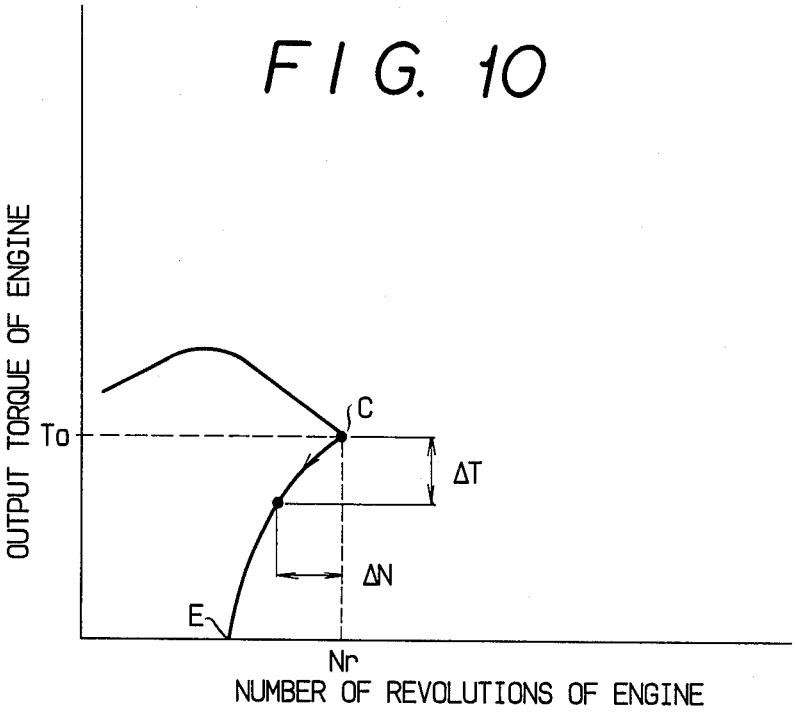
FIG. 10 is a governor control curve for the engine controlled by the method shown in FIG. 8.

FIG. 10 shows the curve CJ established based on $\Delta T$ and $\Delta N$. The symbols $T_0$ and Nr indicate the target (or initial) values set by the throttle lever.

Figure 11:
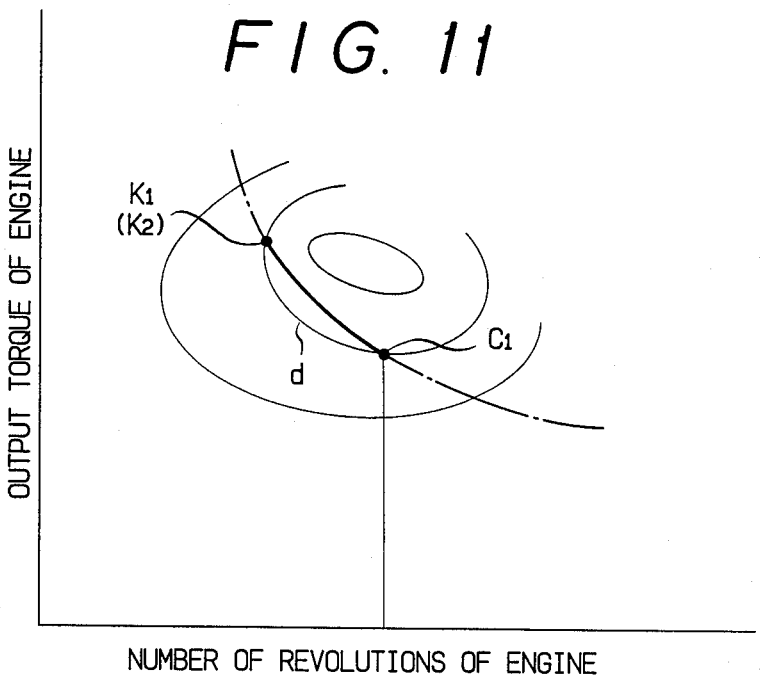
FIG. 11 is a diagram showing a third embodiment of the method of this invention for controlling the output of an engine.
Figure 12:
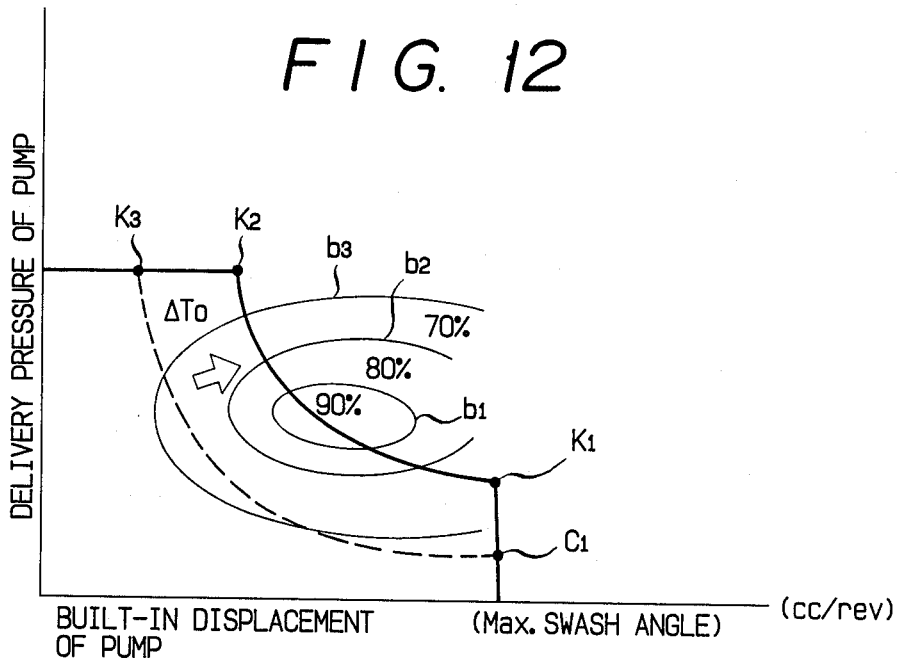
FIG. 12 is a diagram showing the control of a variable displacement hydraulic pump matching the method shown in FIG. 11.

According to a third embodiment of this invention, it controls the outputs of an engine and the variable displacement hydraulic pumps which are driven by the engine. Referring to FIG. 11, the output of the engine is controlled by an electronic governor along a curve from the rated load point $C_1$ representing the number of revolution and output torque of the engine required for achieving the maximum output of the pump, to the point $K_1$ at which the curve crosses a curve d of equal fuel consumption passing through the point $C_1$. When the output of the engine has reached the point $K_1$, a signal representing the output pressure of the pump and a signal representing the number of revolution of the engine are processed by a microcomputer. The angle of the swash plate for the pump is controlled in accordance with the output of the microcomputer to maintain an equal horsepower. As a result, the pump is controlled along the curve $K_1K_2$ shown in FIG. 12. The curve $C_1K_3$ in FIG. 12 is a conventional control curve.

Figure 13:
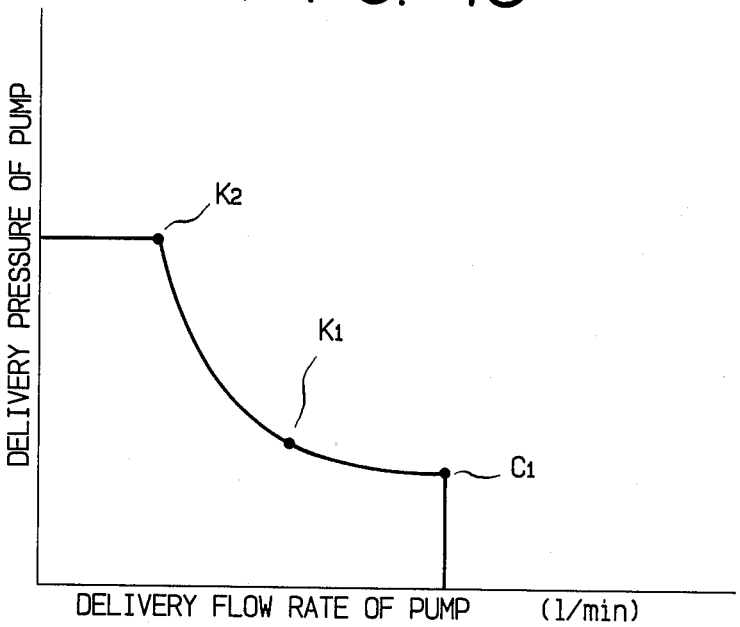
FIG. 13 is a graph showing the output of the pump obtained by the control shown in FIG. 12.

The built-in displacement of the pump increases along the curve from point $K_2$ to $K_1$ with a reduction of the load thereon. When it has reached the point $K_1$ at which the swash plate has a maximum angle, the swash plate is maintained at its maximum angle by a signal from a potentiometer, and the fuel injector is so controlled as to reduce the amount of fuel injection and thereby control the output of the engine along the curve $K_1C_1$ in FIG. 11. The output performance of the pump obtained by the control as hereinabove described is shown in FIG. 13. It shows a curve of equal horsepower defined by the combination of the engine control curve $C_1K_1$ and the pump control curve $K_1K_2$.

A control system which may be employed for carrying out the engine and pump control as hereinabove described is shown by the block diagram of FIG. 14. The output of the engine is set at the number of revolutions Nr by a throttle lever, and matches the load on the pump at the point $C_1$ in FIG. 15 (also FIG. 11). If the load on the pump increases, the output of the engine is controlled along a curve $C_1$-$C_1'$-$K_1$ of equal horsepower as shown in FIG. 15.

Figure 14:
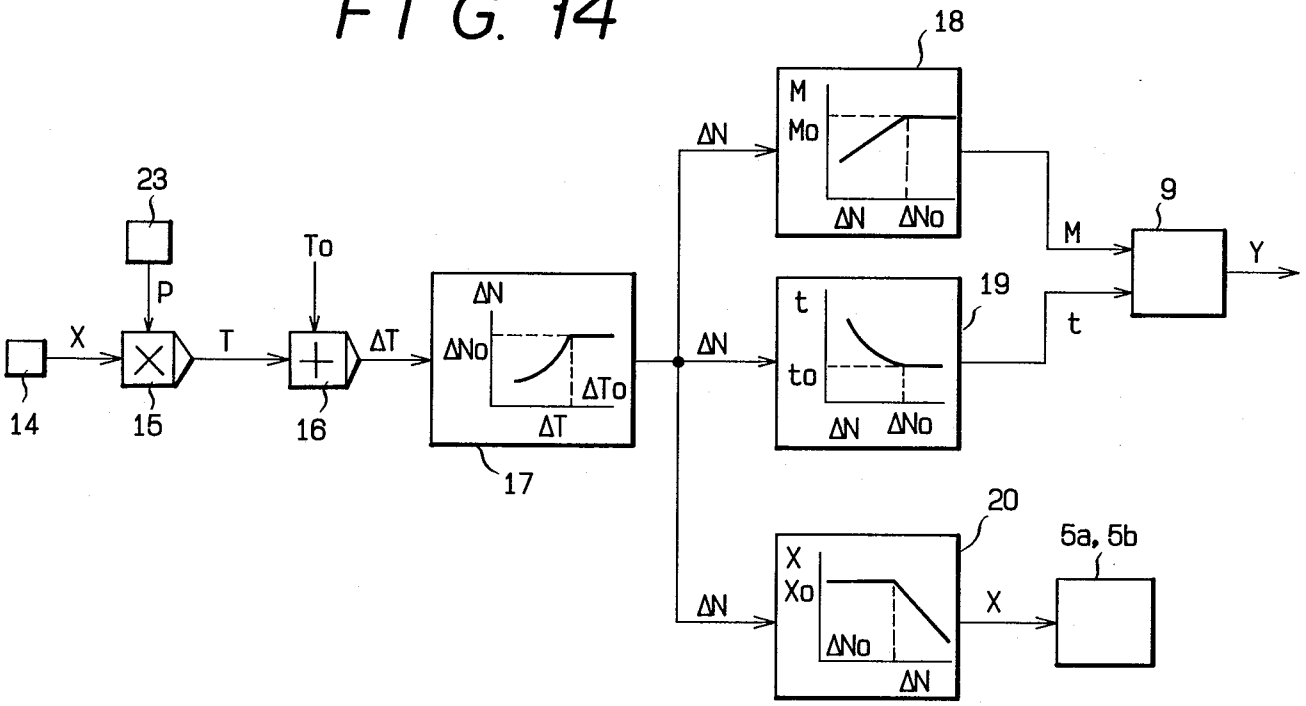
FIG. 14 is a block diagram of a control system which is employed for carrying out the controls shown in FIGS. 11 and 12.

Referring further to FIG. 14, a signal P representing the actual output pressure of the pump is inputted from a pump output pressure detector 23 to a first operator 15, and a signal X representing the tilted angle of the swash plate for the pump, i.e., the actual output of the pump, from a tilted angle detector 14 to the first operator 15. The load torque of the pump is obtained by the first operator 15 and a signal T representing it and a signal $T_0$ representing the torque corresponding to the target number of revolutions Nr set by the throttle lever are inputted to a second operator 16. The second operator 16 outputs a signal $\Delta T$ representing the difference between $T_0$ and T only when T is greater than $T_0$. The signal $\Delta T$ is inputted to a first function generator 17 and converted to a signal $\Delta N$ representing the difference between the target and actual number of revolutions of the engine. The first function generator 17 is designed for storing $\Delta T$ and $\Delta N$ in a relationship which ensures that the curve $C_1K_1$ in FIG. 11, or curve of equal horsepower $(T_0+\Delta T)\times(Nr-\Delta N)=T_0\times Nr$, be constant. If the load on the pump has increased by $\Delta T$, the number of revolutions of the engine is reduced by $\Delta N$ so as to match the load on the pump at point $C_1'$ on the curve $C_1K_1$ of equal engine horsepow shown in FIG. 15.

The signal $\Delta N$ is inputted to a second, a third and a fourth function generator 18, 19 and 20. It is converted by the second function generator 18 to a rack displacement signal M, and by the third function generator 19 to a fuel injection timing signal t to set the amount Y of fuel injection. The second and third function generators 18 and 19 are preset for ensuring that the output of the engine be controlled along the curve $C_1K_1$ in FIG. 15, as the first function generator 17 is.

Figure 15:
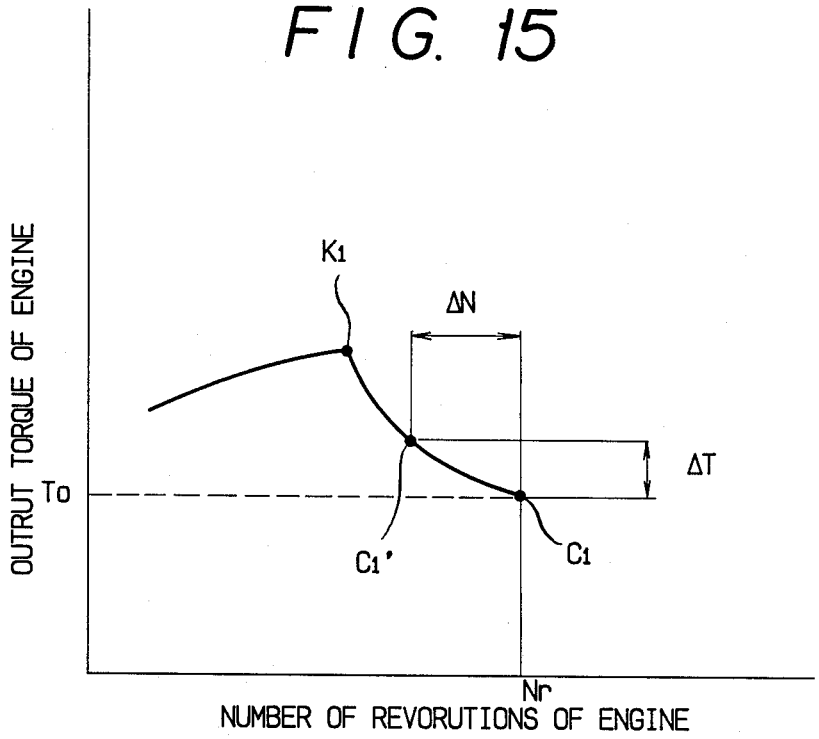
FIG. 15 is a graph showing the engine output control achieved by the method shown in FIG. 11.

If the load on the pump further increases, it reaches the point $K_1$ in FIG. 15 (also FIG. 11). At the point $K_1$, the torque signal $\Delta T$ is equal to $\Delta T_0$ and the number of revolutions signal $\Delta N$ is equal to $\Delta N_0$ and even if the torque may undergo any further change (i.e., $\Delta T$ may become larger than $\Delta T_0$), the signal $\Delta N$ remains equal to $\Delta N_0$ Accordingly, the rack displacement signal M remains equal to $M_0$ and the fuel injection timing signal t remains equal to $t_0$. Therefore, the engine continues to produce the output shown at the point $K_1$.

In case $\Delta T$ is larger than $\Delta T_0$, the output of the engine is not controlled, but the output of the pump is controlled. The signal $\Delta N$ is inputted to the fourth function generator 20, too, and converted to a tilted pump angle signal X. The signal X is $X_0$ when $\Delta N$ is not larger than $\Delta N_0$, and decreases with an increase in $\Delta N$ if $\Delta N$ is larger than $\Delta N_0$. If X is equal to $X_0$, the pump is tilted at a maximum angle, and if X is smaller than $X_0$, the tilt angle of the pump is decreased and its output is, therefore, reduced. Thus, the control of the pump makes up for any large change in load, while the output of the engine can be maintained at the level shown at the point $K_1$ in FIG. 15. At any point below $K_1$, the engine is controlled to make up for any such change in load (see FIG. 13).

No mode change is involved in the control method according to the second or third embodiment of this invention.

What is claimed is:

1. A method of controlling an output of an internal combustion engine provided with an electronic speed governor means, at least one variable displacement hydraulic pump driven by the engine, the output setting for said speed governor being variable in a plurality of modes to alter the speed of said engine to the torque requirement of said at least one variable displacement hydraulic pump driven by the engine, characterized in that, said engine is operated in such a manner that the output torque of said engine in a range of high speed revolutions at a rated point of each of said modes is altered to a lower speed at a given point on a curve of equal horsepower of said engine in each mode where the maximum output torque point of the engine on said curve of equal horsepower is adjacent thereto and the fuel consumption is lower than that in the range of said high speed revolutions, whereby the engine and said at least one pump driven by said engine operate with a high efficiency.

2. A method as set forth in claim 1, wherein the number of revolutions of said engine is reduced in accordance with a ratio of reduction in the output torque of said engine to a level below a predetermined value.

3. A method as set forth in claim 1, wherein a swash plate for said at least one pump driven by said motor is maintained at a maximum angle to maximize the built-in displacement of said pump at a low load, the output torque of said engine is increased along said curve of equal horsepower within said predetermined range of equal fuel consumption to increase the output pressure of said pump, and while said increased output torque of said engine is maintained as it is, said angle of said swash plate is decreased to reduce said built-in displacement of said pump along a curve of equal pump output curve to thereby increase the output pressure of said pump with an increase in said load.

4. A method as set forth in claim 2, wherein the number of revolutions of said engine is reduced along a curve stating at said rated point and drawn by a locus of points of minimum fuel consumption on all the curves of equal fuel consumption below said rated point.

* * * * *